US009808690B1

(12) United States Patent
Hurst et al.

(10) Patent No.: US 9,808,690 B1
(45) Date of Patent: Nov. 7, 2017

(54) SHOOT THE BOOTS BRAND BACKYARD AND TAILGATING GAME

(71) Applicant: Lazy Athlete LLC, Newark, DE (US)

(72) Inventors: Scott A. Hurst, Batesville, VA (US); Brenda J. Hurst, Batesville, VA (US)

( * ) Notice: Subject to any disclaimer, the term of this patent is extended or adjusted under 35 U.S.C. 154(b) by 0 days.

(21) Appl. No.: 14/085,529

(22) Filed: Nov. 20, 2013

Related U.S. Application Data

(60) Provisional application No. 61/728,436, filed on Nov. 20, 2012.

(51) Int. Cl.
*A63B 67/06* (2006.01)
*A43B 5/00* (2006.01)

(52) U.S. Cl.
CPC ..... *A63B 67/06* (2013.01); *A43B 5/00* (2013.01)

(58) Field of Classification Search
CPC ..... A63B 23/10; A63B 21/143; A63B 27/02; A63B 31/11; A63B 71/1225; A63B 64/127; A63B 2071/1283; A43B 3/102; A43B 3/20
USPC ..... 273/407, 108.4; 482/79; 473/217, 438, 473/38; 446/41
See application file for complete search history.

(56) References Cited

U.S. PATENT DOCUMENTS 273,460 A * 3/1883 Cain ..... A43B 3/20 36/33
1,637,278 A 7/1927 Renz
1,677,370 A * 7/1928 Roewade ..... A43B 5/02 36/128
2,220,291 A 11/1940 Savoy
3,628,794 A 12/1971 Conture
4,155,580 A 5/1979 Moller
4,402,507 A 9/1983 Hudson
4,458,432 A * 7/1984 Stempski ..... 36/132
4,638,574 A * 1/1987 Roda ..... A43B 3/20 36/7.2
4,718,676 A 1/1988 Collins, Jr.
D299,362 S 1/1989 Malfitano
4,865,318 A 9/1989 Lehmann et al.
4,972,610 A * 11/1990 Tong ..... 36/7.1 R
5,067,727 A 11/1991 Crompton
5,080,371 A 1/1992 Karczewski
5,269,514 A * 12/1993 Adler et al. ..... 473/596
5,275,419 A 1/1994 Kazemi
5,382,028 A 1/1995 Sciandra et al.
5,472,200 A 12/1995 Miller
5,527,597 A 6/1996 Hanks
5,575,483 A 11/1996 Dineen et al.
5,669,803 A * 9/1997 Sweed ..... A63H 33/18 244/154

(Continued)

FOREIGN PATENT DOCUMENTS

EP 1380221 A1 * 1/2004 ..... A43B 23/17

*Primary Examiner* — Aarti B Berdichevsky
*Assistant Examiner* — Rayshun Peng

(57) ABSTRACT

A recreational activity and component pieces for that activity in which one or more participants toss a specially designed article that fits over at least the toe portion of their footwear, the toss using their lower extremities (leg and foot) in combination with upper body for balance and coordination. The activity can be adapted as a game in which the participants or players score points while sometimes negotiating obstacles or making goals depending on the game of choice. The game tests a player's kick toss agility.

22 Claims, 6 Drawing Sheets

(56) References Cited

U.S. PATENT DOCUMENTS

| | | | | |
|---|---|---|---|---|
| 5,815,841 | A | 10/1998 | Spangrud | |
| 5,893,223 | A * | 4/1999 | Glass | 36/132 |
| 5,894,685 | A | 4/1999 | Yates | |
| 5,906,370 | A | 5/1999 | Poisson | |
| 5,938,202 | A | 8/1999 | Williams | |
| 6,052,924 | A * | 4/2000 | Sabat | A43B 3/0031 36/132 |
| 6,161,633 | A | 12/2000 | Gomez | |
| 6,257,998 | B1 | 7/2001 | Ein-Gal | |
| 6,341,780 | B1 | 1/2002 | Pant et al. | |
| 6,383,098 | B1 | 5/2002 | Haumschilt et al. | |
| 6,843,478 | B1 | 1/2005 | Hoepelman | |
| 6,866,268 | B2 | 3/2005 | Christianson | |
| 6,886,275 | B1 * | 5/2005 | Westfall | A43B 3/20 36/128 |
| 6,923,448 | B2 | 8/2005 | Fairbanks | |
| 6,932,344 | B1 | 8/2005 | Soto | |
| D517,782 | S | 3/2006 | Hunter | |
| 8,042,289 | B2 | 10/2011 | Minami | |
| 2004/0108652 | A1 | 6/2004 | Vaden | |
| 2005/0011086 | A1 * | 1/2005 | Goetze | A43B 3/101 36/72 R |
| 2005/0017455 | A1 | 1/2005 | Long et al. | |
| 2005/0127609 | A1 | 6/2005 | Raslowsky | |
| 2007/0199208 | A1 * | 8/2007 | Wilkenfeld | A43B 7/28 36/8.3 |
| 2008/0116644 | A1 | 5/2008 | Knoernschild | |
| 2008/0179834 | A1 | 7/2008 | Fang | |
| 2009/0115136 | A1 | 5/2009 | Voden | |
| 2010/0181726 | A1 | 7/2010 | Bos | |
| 2011/0053714 | A1 | 3/2011 | Skowronski | |
| 2011/0074109 | A1 | 3/2011 | Werth | |
| 2011/0215528 | A1 | 9/2011 | Conville et al. | |
| 2011/0278796 | A1 | 11/2011 | Baculy | |

* cited by examiner

SHOOT THE BOOTS BRAND BACKYARD AND TAILGATING GAME

CROSS-REFERENCE TO RELATED APPLICATIONS

This patent document claims the benefit of U.S. Provisional Patent Application Ser. No. 61/728,436, filed on Nov. 20, 2012. The entire contents of this commonly owned patent application are herein incorporated by reference.

STATEMENT OF FEDERALLY SPONSORED RESEARCH

None.

BACKGROUND OF THE INVENTION

1. Field of the Invention

The instant invention relates to a recreational activity featuring kick tossing. More specifically, it relates to launching or tossing a projectile from one's foot by employing a kicking motion.

2. Discussion of Related Art

The ease with which one can locate information on the Internet has revealed the presence of something of a shoe golf subculture that apparently has existed for a number of decades. It is clear from the "histories" that are posted that this activity or game is claimed to have been invented by various persons in various locations at various times. The common denominator is that the activity or game of "shoe golf" involves launching one's shoe from one's foot using a kicking motion of the leg bearing the shoe to be launched. Typically the object of the game is to aim the shoe toward a specific target.

This "traditional" form of shoe golf suffers from a number of drawbacks and shortcomings. For one, kicking one's actual shoe likely will result in enhanced wear and tear, as the shoe lands on dirt, concrete or asphalt. Also, the shoe is likely to become soiled from this activity, requiring more frequent cleaning. Third, one has to walk with exposed socks or bare feet to rendezvous with one's kicked shoe, which can expose one's foot to injury or expose one's socks to dampness. Fourth, most shoes are not designed for kicking from one's foot, resulting in poor aerodynamic performance and inconsistent kicks. Fifth, the existing shoe golf subculture does not seem to have a goal or target of standardized size.

The embodiments of the instant invention address and solve these shortcomings in the traditional game of "shoe golf".

SUMMARY OF THE INVENTION

Embodiments of the instant invention present a recreational activity in which players toss specially designed toe box referred to as a "boot" using their lower extremities (leg and foot) in combination with upper body for balance and coordination to score points, while sometimes negotiating obstacles or making goals depending on the game of choice. The activity tests a player's kick toss agility.

BRIEF DESCRIPTION OF THE FIGURES

The illustrations included in this application depict at least the major components of the instant kick toss game, where like numbers refer to like components. The Illustrations also depict participants playing one version of the game.

FIG. 2A is a side view. FIG. 2B is a top view. FIG. 2C is a side view shown in cross-section. FIG. 2D is a rear view, that is, looking at the rear, open portion of the Toe Box. FIG. 2E is a front view, that is, looking toward the front or nose of the Toe Box. FIG. 2F is an isometric view of the Toe Box taken from slightly above the horizontal and slightly to the front.

DEFINITIONS

Boot—A rubberized Toe Box that is designed to fit around most standard tennis shoes or casual footwear and is weighted in the front to provide throwing performance and control.

Goal—A plastic-like framed net that is used in most recommended Shoot The Boots™ games. The framed net is a designed to catch the Boot from a variety of distances.

Scoring Tarp—A sheet that lays flat on the ground and whose purpose is to provide additional ways that a player may score other than making a basket, that is, other than by directing the Boot into the net through the upper ring of the Goal.

Bean Bag Markers—A bean bag used to mark the location of a designated shot.

Accessories—Additional materials to enhance the game options and experience. Among the possible accessories are:

- Official Shoot The Boots™ labels—Used to show your game is official
- Flag Markers—Used to mark throwing positions for different games
- Team Banners—Used to show support for your favorite team
- Sound Devices—Used to signal when a goal is made

DETAILED DESCRIPTION OF EMBODIMENTS OF THE INVENTION

General Concept

Figure 1:
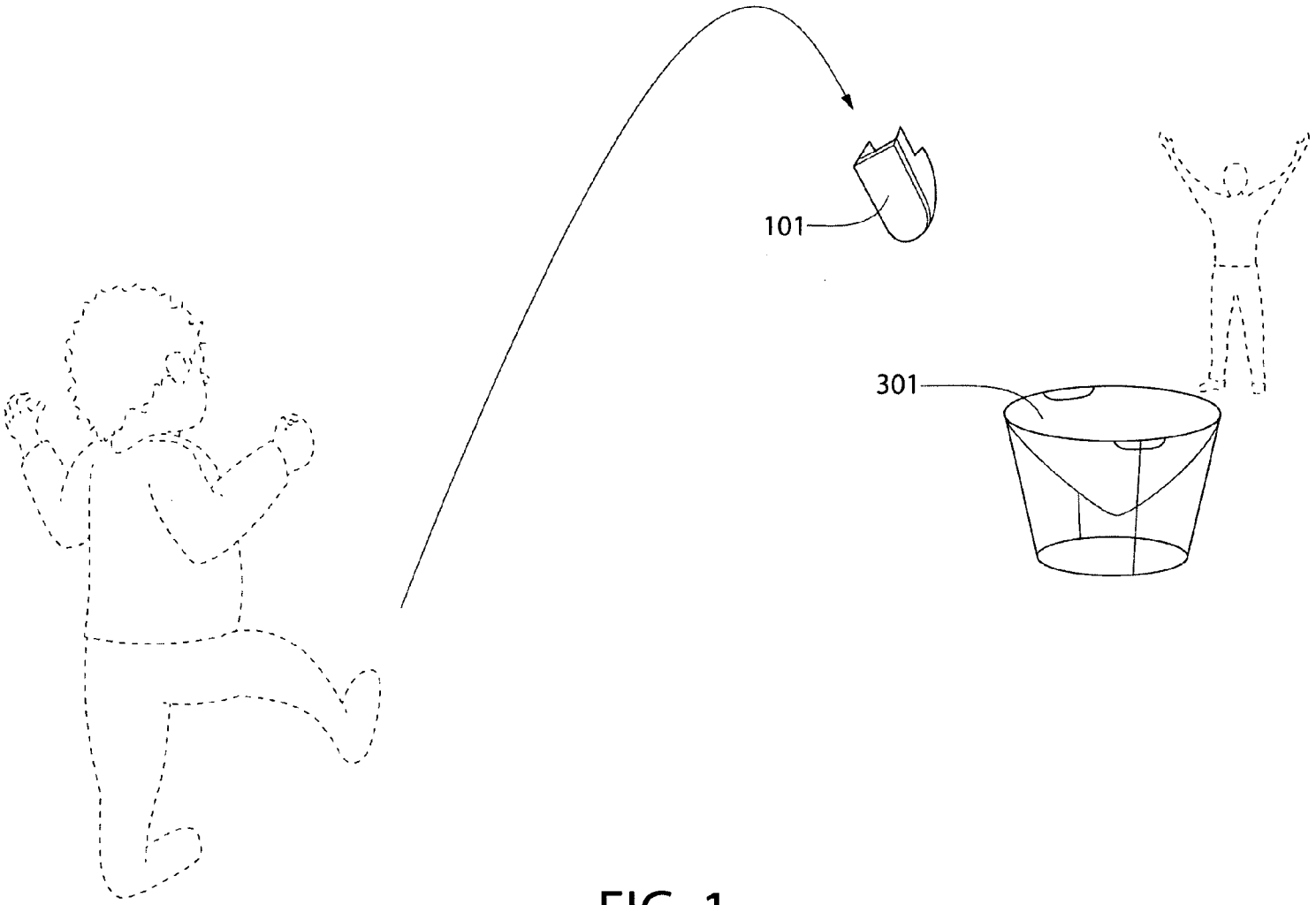
FIG. 1 is a perspective view of a game participant launching a Toe Box toward a Goal by means of a kick toss.

Embodiments of the instant invention present a recreational activity in which players toss a specially designed toe box, sometimes referred to as a "boot", using their lower extremities (leg and foot) in combination with upper body for balance and coordination. This activity is readily amenable to being adapted as a game, where points are scored while sometimes negotiating obstacles or making goals, depending on the game of choice. The game tests a player's kick toss agility. The activity or game can be played by one or more participants. FIG. 1 shows a player kick tossing a Boot 101 toward a Goal 301.

At a minimum, a kit for playing various Shoot The Boots™ brand backyard and tailgating games contains a plurality of Boots and at least one target, which may be a Goal and/or a Scoring Tarp. A kit optionally may contain the other components described above, or alternatively, these may be purchased separately.

Boot—The "boot" or toe box, resembles the toe portion of a shoe, but larger to enable it to fit over at least the toe portion of most standard shoes, including casual footwear such as tennis shoes or sandals. The fit is not a tight fit, but instead is sufficiently loose as to enable the toe box to be slidably released from the wearer's shoe once the wearer kicks the toe box forward. The Boot comes in two sizes based on age, shoe size, type of shoe or preference. The sizes offered are "Fits Most" and "Smaller"; thus, the Boot should be able to fit properly over a child's shoe. The Boot is also designed so the player may easily slip it on and play without every bending over or using his or her hands. The Boot may be plastic or may be rubber or "rubberized" (e.g., rubber coated).

Figure 2A:
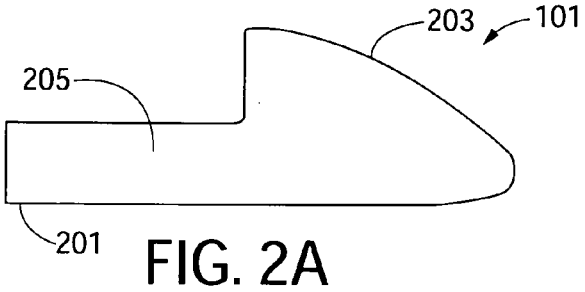
FIGS. 2A through 2F show a variety of views of the Toe Box. In particular.
Figure 2B:
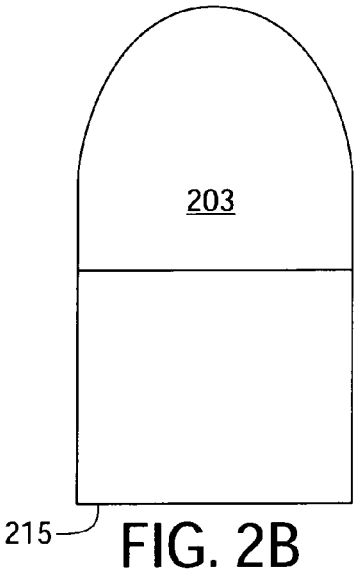
Figure 2C:
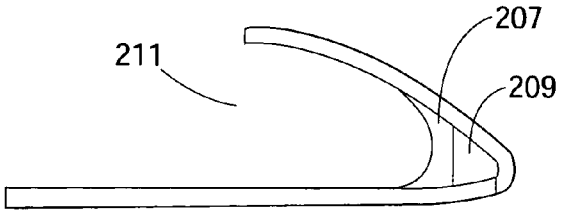
Figure 2D:
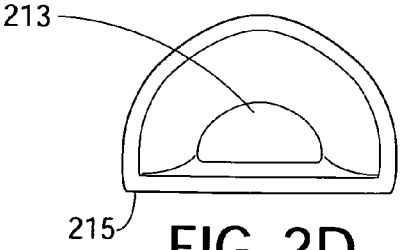
Figure 2E:
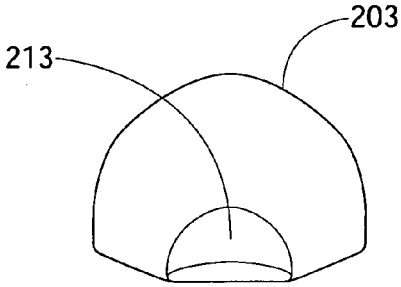
Figure 2F:
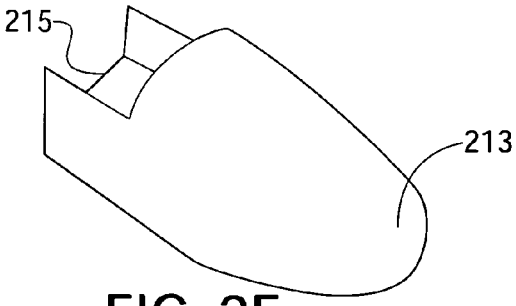

FIGS. 2A through 2F show a variety of views of the Boot 101. Referring first to FIG. 2A, what is shown is a side view of the Boot featuring sole 201, upper 203 and side wall 205. FIG. 2B shows the top view, which view well illustrates rear edge 215. FIG. 2C gives a longitudinal cross-sectional view. This view best shows the opening 211 in the Boot, in which a player inserts his footwear-adorned foot. The opening 211 may extend all the way to rear edge 215 such that the Boot does not engage the heel of the foot or footwear like a regular shoe would. FIG. 2D shows a rear view. FIG. 2E shows a front view, looking from the nose 213 of the Boot toward the rear. FIG. 2F provides an isometric view of the Boot. The Boot tapers slightly from the rear to the front. Also, the rear may be referred to as the "proximal end", since that is the end that is closest to the participant when the Boot is worn. Conversely, the front or "nose" portion of the Boot may be referred to as the "distal end".

The toe box/Boot or at least its covering (external surface) may be fabricated from one or more polymer materials such as polyvinylchloride, polyethylene, low density polyethylene (LDPE), high density polyethylene (HDPE), thermoplastic elastomer (TPE), polypropylene, ethylene vinyl acetate, ELVAX® EVA ethylene vinyl acetate copolymer, acetate, butyrate, propionate, silicone, latex, copolymers thereof, and mixtures thereof. The Boot may also contain or be reinforced with other materials such as metal (e.g., steel) or leather. Techniques to fabricate the Boot are those known to those skilled in the art, such as injection molding.

Although rubber or plastic are envisioned as desirable materials for fabricating the Boot, other materials may also function well, provided that they allow for easy glide of footwear into the Boot; for example, the material should be smooth so that footwear that features a rubber exterior surface does not stick when inserted into a Boot.

Where multiple persons are participating in the activity or game, a plurality of Boots may be provided, with a particular Boot assigned to a particular participant. Accordingly, and to help assist the participants in keeping track of their assigned Boot, the Boots may be provided in different colors or patterns. Exemplary colors include orange, blue, yellow and green. Alternatively or additionally, the various Boots may be identified by numbers, letters or other insignia. The Boot optionally may feature licensed logos or colors, for example, to show support for a favorite professional or school sports team.

Figure 2G:
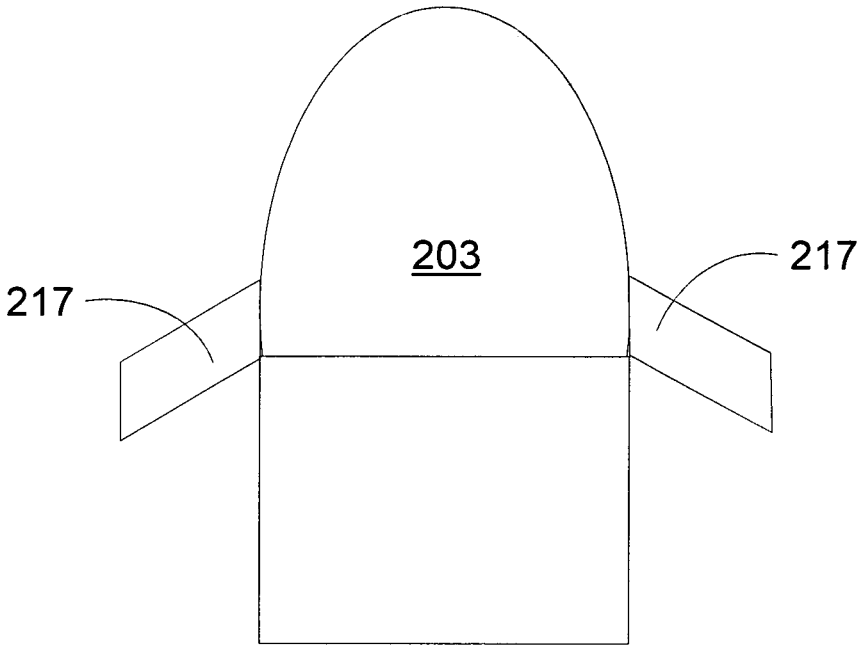
FIG. 2G is a top view of an embodiment of the toe box that features a pair of fins.
Figure 3:
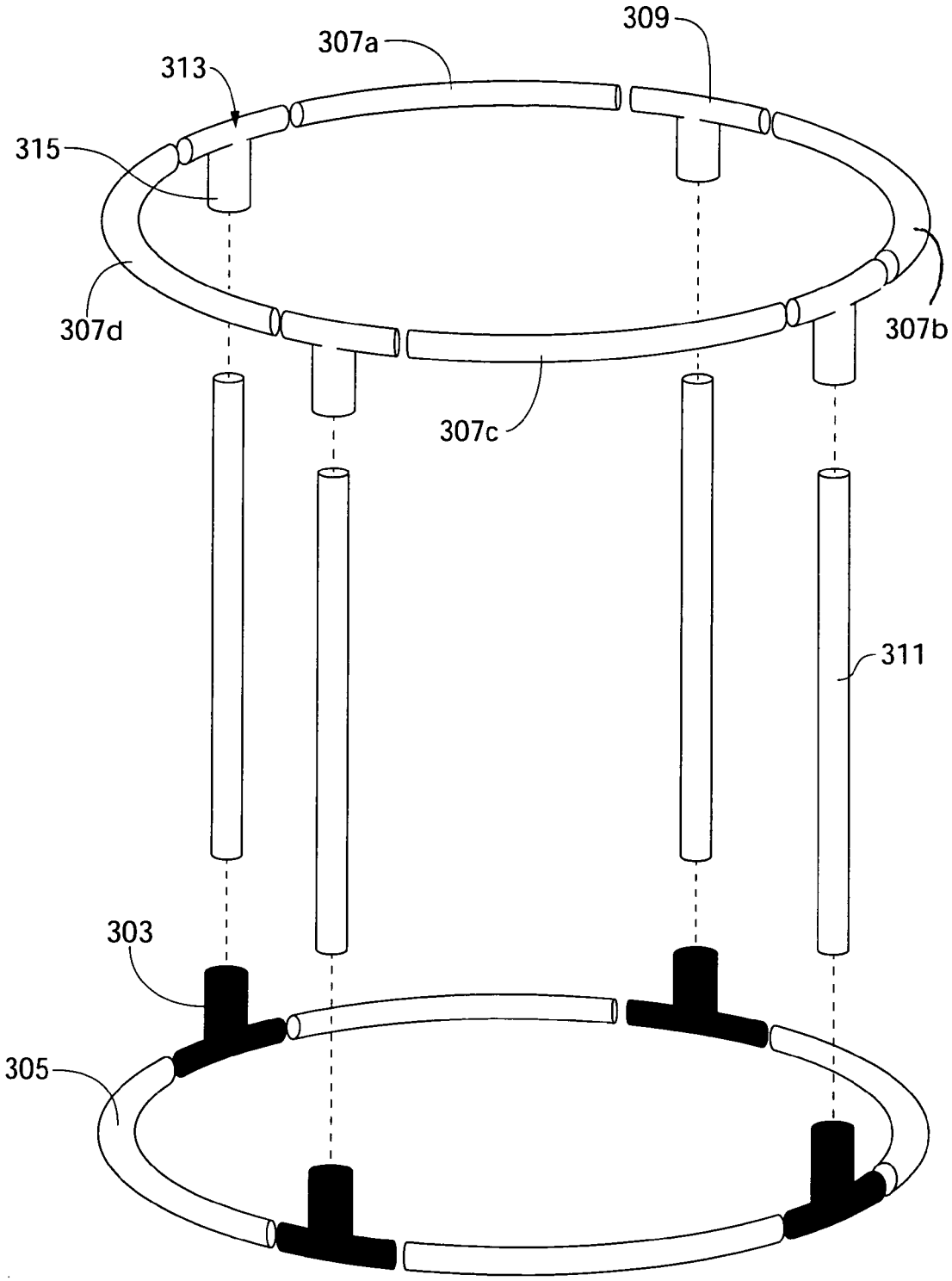
FIG. 3 depicts an isometric "exploded" view of the structural components of the Goal, that is, without the net.

To provide for more consistent aerodynamics/flight trajectory, the Boot may feature one or more wings or fins, as best seen in FIG. 2G. It may also feature additional weight 207 in the front section, best seen in FIG. 2C. Weight placement may be in proportion with the specific gravity of material used. At present, the amount of weight used is 10 to 25 ounces; however, manufactured models are estimated to use less weight due to material choice, for instance, 7, 5 or even 3 ounces. The weighted front may be accomplished with manufactured material, manufactured material with added material to make added density or added material such as a type of metal at the type of mold manufacturing. The Boot may also feature material padding 209 or material in front of weighted area 207 for shock absorption and safety. The bottom of the Boot may be designed so weight on the front portion of the Boot forces the heel of the boot to tilt.

The following are approximate dimensions of the "Fits Most" size of the Boot. Please note that the specifications/measurement for the thickness of the toe box can vary depending on the thickness of the material used in its fabrication.

Side View

1. Height of the Boot Opening 211=3 inches
2. Height of Sidewall=2.3 inches
3. Height of Boot inside front curvature=2.5 inches Top View 1. Inside width of nose 213 of the Boot=3 inches
2. Inside base width for footwear placement front=4.5 inches
3. Inside length for footwear placement-6 inches
4. Inside top width for footwear release area=4.75 inches
5. Inside base width rear=5 inches To kick toss a Boot, the participant first orients the Boot 101 on the ground such that the sole is contacting the ground. The participant then inserts his foot, which may be bare or bearing footwear, into the opening 211 until it can be inserted no further. If the participant were to begin with both feet even, the next step is to take one step forward on the foot not bearing a Boot, and to lift the foot bearing the Boot slightly off the ground. Then, the participant steps forward with the foot bearing the Boot and makes a kicking motion with this foot. This should have the effect of launching or tossing the Boot from the foot and sending it hurtling through the air. The participant may bend the kicking leg slightly at the knee before and during the kick toss. The arms may be extended to the side to enhance balance.

Target

In many embodiments of the activity, a target may be employed. In one such embodiment, the target may take the form of a "Goal" featuring a framed net, similar to a basketball net and hoop. As with a basketball hoop, the instant framed net may be in the form of a ring with netting material attached around the circumference of the ring. The framed ring may be parallel to the ground, that is, horizontal, and suspended a fixed distance above the ground. Unlike a basketball hoop, however, the instant framed net may range in diameter from about 10 inches to about 40 inches with 30 inches being exemplary, and may lie from about 15 inches to about 40 inches above the ground with 30 inches being exemplary. Further, the ring of the instant framed net optionally may be angled or tilted slightly; that is, the axis of the ring may be angled slightly away from vertical. The framed net is designed to catch the Boot from a variety of distances. The framed net is also designed so that the player may easily set up and tear down the Goal in seconds. The design is cost effective, lightweight, easy to store and transport. This Goal is used in most recommended Shoot The Boots™ games. The Goal optionally may feature licensed logos or colors, for example, to show support for a favorite professional or school sports team.

In one embodiment, the ring of the framed net of the Goal (the upper ring) has a diameter of about 30 inches and lies about 28 inches in elevation above the bottom ring. These dimensions are approximate, and may vary somewhat depending on a variety of circumstances or factors such as manufacturing considerations, or necessary adjustments to not make the games too difficult or too easy.

Other considerations are that the Goal should be easy to set up and tear down; should be easy to transport and store; should be cost effective to manufacture, ship and store; and should stay in place and not tip over when the wind blows or when receiving an impact from an incoming (airborne) Boot.

The parts or components of the Goal will now be described with reference to FIGS. 3, 4, 6A and 6B.

The base or "support footing" is assembled as follows: For purposes of shipping and compact storage, the flexible poles intended to form the base and the ring are manufactured in a straight condition, and after disassembly of the game, will return substantially to a straight condition.

These poles are highly flexible, however, and can easily be bent into an arc. Assembly of the base begins by inserting the upper or horizontal portion of a "T" connector 303 onto one end of each of the four flexible poles 305 that form the base 605. The other end of each pole is then inserted into the other half of the upper or horizontal portion of the T connector, forming a loop or circle. The lower or vertical portion of each T connector is now "empty", but when finished, will be connected to a vertical support.

Next, the framed ring with net is assembled.

Figure 4:
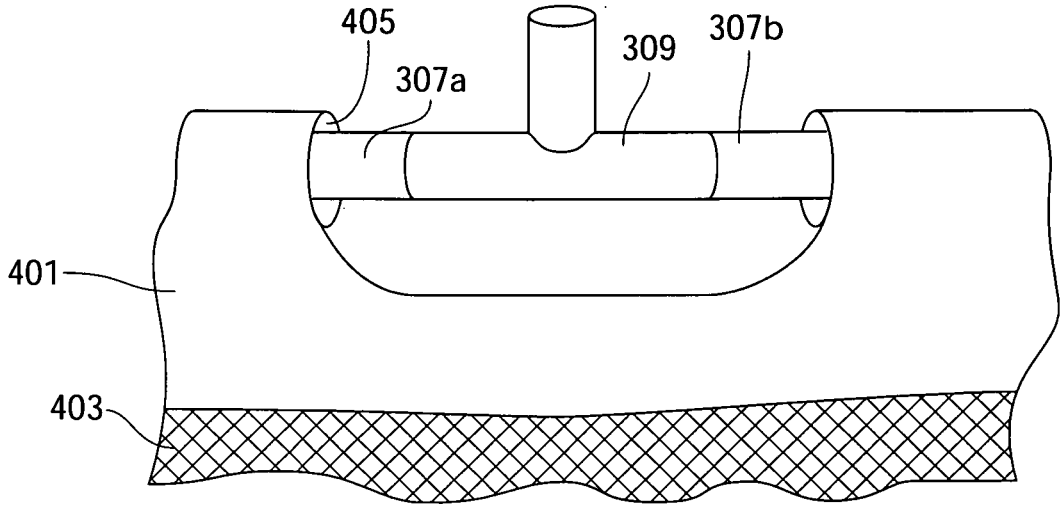
FIG. 4 is a close-up side view of the upper part of the Goal, showing how the ring featuring connected flexible poles and T connectors engages the sleeve portion of the net.

This assembly procedure is very similar to that of the base. In particular, and with reference to FIGS. 3, 4 and 6A, four flexible poles 307*a*, 307*b*, 307*c*, 307*d* are connected together to form a ring or circle using the upper or horizontal portion 313 of four T connectors 309 to attach the poles. Here, however, before the last pole is connected to the first to form a loop, the pole segments are inserted into the sleeve 401 of the net 403 through one of the four openings 405 in the sleeve (see FIG. 4). When the pole insertion into the net sleeve is complete, the ends of the first and fourth pole are connected to one another, thereby forming a ring 607 of flexible poles supporting a net—a "framed" net, in other words. Again, both portions of the upper or horizontal portion of each T connector are attached to a pole, leaving the lower or vertical portion 315 of each T connector open and available to attach to a vertical support 311. In FIG. 4, the T connector is depicted as pointing up, but this is simply for clarity of the drawing. In service, it points in the opposite direction.

Finally, the framed ring is attached to the base by means of the vertical supports 311, sometimes referred to as "uprights". Specifically, each end of a vertical support 311 is inserted into a T-connector 303, 309. The net is sewn to make a cone structure that points downward (toward the ground) when the Goal is set up for play.

In one embodiment, each of the four flexible poles is about 10.5 inches in length. They may be attached or connected to one another by means of a bungee cord or string to hold flexible poles together when disassembled. Bungee strings also keep the goal together. The T connectors, also known as "three-way connectors" are sockets or receptacles and are about 2.5 inches in length. They may be metal or plastic. Each vertical support is about 27 inches in length.

Figure 6A:
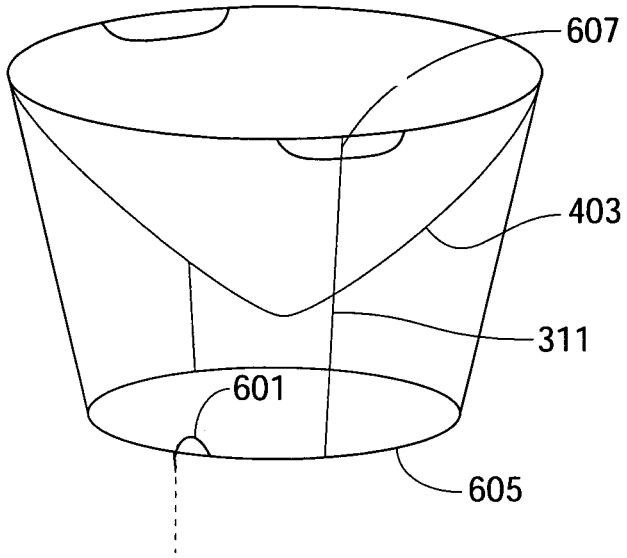
FIG. 6A is an isometric view of an assembled framed-net Goal.
Figure 6B:
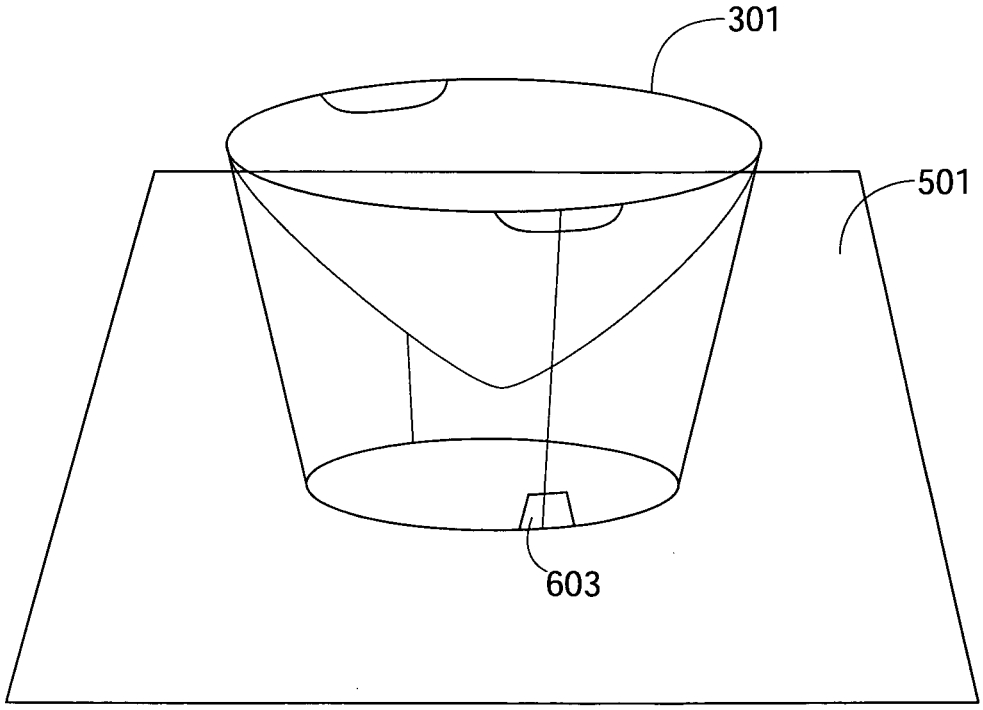
FIG. 6B is a perspective view of a framed-net Goal used in conjunction with a Scoring Tarp. For clarity of illustration, the scoring zones have been omitted from this depiction of the Scoring Tarp.

Referring now to FIGS. 6A and 6B, the Goal 301 may be temporarily attached to the ground by means of the U-shaped stakes or the weights. Specifically, a U-shaped stake 601 may be pressed into the ground such that one of the pair of prongs of a U-shaped stake is on each side of the base. In addition or alternatively, the Goal may be secured to the ground by placing one or more weights 603 over the base. The weights 603 can be a sewn sleeve filled with necessary weighted material. The weights 603 may also feature Velcro® hook-and-loop attachment to make set up and tear down easy.

Scoring Tarp

In another embodiment, the target may be in the form of a tarp or sheet ("Scoring Tarp"). The tarp may be marked to define different zones or regions, for example, for awarding various points for landing the toe box in that particular zone or region. It may be desirable to award a greater number of points for landing the toe box at or near the center of the tarp than for landing it in zones or regions closer to the periphery of the tarp. The zones or regions of the tarp may be arranged in concentric circles, that is, as a "bull's eye." Alternatively, the zones may be defined by boundaries that extend from the center outward in a sort of radial arrangement.

The Scoring Tarp's purpose is to provide additional ways that a player may score other than "making a basket". The benefit is that the additional scoring methods keep the game more interesting and give players a sense of accomplishment for getting the Boot close to the goal. The tarp also offers a way for the player to develop a strategy similar to playing darts where it is not always beneficial to go for the bull's eye on every shot. Furthermore the tarp provides a better chance for beginners to score.

The Scoring Tarp may be constructed of cloth or vinyl or other very flexible plastic, or other materials that can be folded and unfolded quickly and easily. It may feature weights attached to the corners or edges (for example, sewn in) to help hold the tarp down on the ground during windy conditions, and while participants are walking on it.

Figure 5:
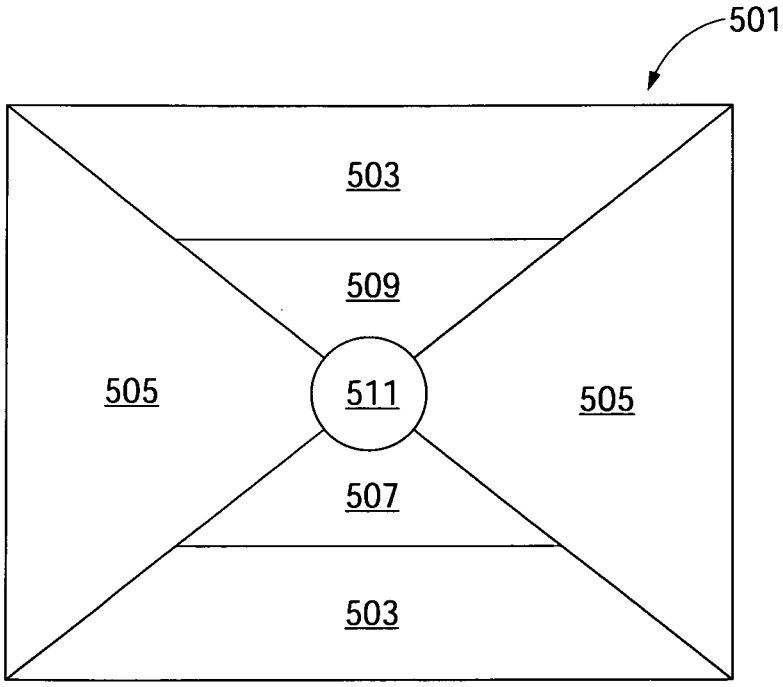
FIG. 5 illustrates a top view of a Scoring Tarp.

In one embodiment, the Scoring Tarp is approximately a five foot by seven foot sheet that lays flat on the ground and is weighted on the outside to keep it in place. In another embodiment, the scoring tarp measures about ten feet square. The Scoring Tarp has numbered scoring zones. For instance, and referring specifically to FIG. 5, the scoring tarp 501 may feature two "1" Zones 503, two "2" Zones 505, one "3" Zone 507, one "4" Zone 509, and one "5" zone 511 in the center. Generally zone 1 is front and back, zone 2 is on the sides, zone 3 is front between 1 and 5, zone 4 is back between 1 and 5, zone 5 is in the middle underneath the goal, matching the circumference of the goal's bottom. A "1" Zone means that the player shooting her Boot into this zone scores one point.

The Scoring Tarp can be used atone or together with the framed net.

While not essential, there are a number of other components that can add to the utility and enjoyment of the Boot tossing activity.

Bean Bag Markers—the markers serve a dual purpose. The primary purpose is to provide the player with easy way to place markers for designated shot locations. Unlike flags, bean bag markers work on grass, cement or any other playing surface with ease. Also, the bean bags accommodate a secondary purpose of playing bean bag toss games.

Rubberized Goal Feet—Used to keep the Goal in place on pavement or gym floors

Playing Area

General Playing Areas:

1. Indoors—perfect for gymnasiums when using the included accessories designed for indoor use (Rubberized Goal Feet). Be careful not to hit the ceiling, light fixtures or any other hazards. Do not use in low-level ceiling environments.
2. Outdoors—Great for nearly all outdoors flat praying surfaces. Be cautious of people, houses and cars. Natural obstacles such as trees and gym sets can add some variation and challenge to the game. Be sure to be safe at all times.

Common Outdoor Playing Areas:

1. Backyard
2. Tailgating
3. Camping
4. Park
5. Parties
6. Concerts

General Rules and Play

The following paragraph provides all recommended general rules that apply to all game configurations and game options.

One Step Rule—Players should use the "One Step Rule" when playing games that require consecutive shots. The One Step Rule means that the player is not allowed to move the Boot location when playing games that require consecutive shots. However, the player is allowed to turn the Boot so that it is facing the intended target or goal and so they can easily slip their foot in. Once the player has inserted her foot into the Boot she is allowed to take one step in any direction (in most cases toward the target or goal) and take her shot. The foot in the Boot is referred to as the Shooting Foot. The foot used in the one step is referred to as the Approach Foot.

Game Configurations

Full Court—Full Court is any game that involves two goals with kick toss lanes opposing one another. Some games may require a scoring tarp as well.

Half Court—Half Court is any game that involves one goal with defined or undefined kick toss lanes. Half court games can also be 360 degrees. In other words, players can shoot at the goal from any direction.

Freestyle—Freestyle is any game that involves multiple goals or unconventional targets or goals other than what is described above. This can be trees, gym sets or any common item found in a yard.

Game Options

The game options will be provided for each type of configuration. The game options describe different versions of the Shoot The Boots™ kick toss game. Each game option will include the name, description, set-up instructions for playing, rules of play and scoring. Players may add their own rules or scoring to the game, or to make up new games.

The following examples illustrate with still more specificity several embodiments of the instant invention, especially pertaining to methods for playing the instant kick toss game. These examples are meant to be illustrative in nature and should not be construed as limiting the scope of the invention.

Full Court Options

Examples 1 through 3 describe the playing options available in the "full court" configuration, namely, "Long Shot" and "Mini Golf". Long Shot can be played "singles" or "doubles". Mini Golf can be played with one to four people.

Long Shot

Description—set two goals with scoring tarps around 30 to 50 feet apart on a flat playing surface. The goals are placed on the round center section of each scoring tarp labeled "5".

EXAMPLE 1

(Singles) (2 People) (1 Versus 1) Each Player shoots at one goal and then walks down together to shoot the Boots back to the other goal. Continue playing back and forth until the game is completed by the first player who makes over 20 points. Players should alternate shooting between each shot.

EXAMPLE 2

(Doubles) (4 People) (2 Versus 2) Two Players from the opposing team shoot at one goal and then the other two players of opposing teams shoot the Boots back to the other goal. Continue playing back and forth until game is completed by the first team who makes over 20 points. Points will be award to the players based on where the Boot finally rests after each kick toss as described in the rules below.

Rules:

I. Players must remain behind the goal when kick tossing with both the Shooting Foot and the Approach Foot. No points are awarded if the player crosses the line.

II. Points will be awarded if the boot lands on the scoring tarp by the respective number of the section it lands in. If the boot rests on the border of two or three sections the player is awarded the highest number. If the Boot rests on the border partially on the tarp the player is awarded a point for the respective section.

III. Ten Points will be awarded if the Boot lands in the goal. Two baskets made in a game results in a win.

IV. Teams must complete an equal number of turns before the game is over.

V. In the event of a tie game, the winner is decided in an overtime round. First team to score a point in a complete round wins. Overtime rounds continue until the tie is broken.

Scoring:

A player scores two ways below.

1. 1-5 Points on Scoring Tarp—The Boot rests in one of the sections of the scoring tarp after a shot. The number of the section indicate the points earned.
2. Goal—The Boot rests in the netted goal. A player should yell "Shoot the Boots" when this happens.

EXAMPLE 3

Mini Golf—(1-4 People)(Singles or Teams)

Description—set two goals around 30 to 50 feet apart on a flat playing surface. Scoring tarps are not needed unless you want to keep it to resemble the green on a golf course.

Each player takes one shot from the first goal location toward the second goal location. Players move to where their shot landed to take a second shot. The process is repeated until you make the Boot into the basket, similar to playing Golf. The player or players that takes the least amount of shots to make the Boot in the goal earns a point for that round. First player to make 12 points wins. Players may need to get creative with their shot when the Boot rests beneath the goal.

Rules:

I. Players must remain behind the goal when kick tossing with both the Shooting Foot and the Approach Foot for the first shot. No points are awarded if the player crosses the line.

II. Players will then walk down the field to where the shot has landed and take turns making the next shot. The process is repeated using the One Step Rule until everyone puts the Boot in the basket.

III. Players must keep track of the number of shots it takes them to make a goal.

IV. The player with the lowest number of shots to make a basket receives one point for the round. If two or more players have the same number of shots they will also receive the point.

V. Six points will be awarded if a shot lands in the basket on the first shot only (hole in one). Two "hole in ones" for a player will result in a win.

VI. A player must exceed 12 points to win.

VII. In the event of a tie game, the winner is decided in an over-time round, First player to score a point in a complete round wins. Overtime rounds continue until the tie is broken.

Scoring:

The first player to score 12 points wins.

1. Lowest number of shots per round—One point
2. Hole in One—Six points

Half Court Options

Examples 4 through 6 provide options available for play using the half court configuration.

EXAMPLE 4

King of the Boot Shoot—(1-4 People)(Singles or Teams)

Description—set a goal on a flat playing surface allowing at least 30 feet for a throwing lane. The scoring tarp is not needed for this game. Place bean bag markers every five to six feet or spaced to your own preference going in a straight line away from the goal. Each player will start the game by taking a shot at the closest Bean Bag Marker to the goal by rotating turns. A player will progress to the second furthest Bean Bag Marker from the goal only when they make it in the basket at the first Bean Bag Marker location. The other players will stay at the first Bean Bag Marker location until making a goal. Players keep rotating through turns attempting to kick toss the Boots into the goals until someone has reached the bean bag marker location located furthest away from the goal and makes it. The player who achieves making a successful goal shot at all locations first may then claim the bragging rights to being the "King of the Boot Shoot!"

Rules:

I. Players must remain behind the Bean Bag marker when throwing with both the Approach Foot and the Shooting Foot for each shot. No progression to the next marker or a win is awarded if the player crosses the line.

EXAMPLE 5

Around the World—(1-4 People)(Singles or Teams)

Description—this game is similar to the game "Around the World" in basketball. Set a goal on a flat playing surface with at least 30' in all directions around the goal. Strategically place Bean Bag Markers at locations at different distances around all sides of the goal. Players may choose to make some shots more challenging than others by placing markers in locations where there are obstacles. Be sure not to make the shots too hard where they cannot be made. Each player will start the game by taking a shot a designated start marker location and rotating turns until a basket is made. A player will progress to a second Bean Bag Marker location counter-clockwise once a basket is made. The other players will stay at the first marker location until making a basket. Players keep rotating turns attempting to make baskets until someone has reached the last marker location and makes it. The player who achieves making a basket at all locations first may then claim the bragging rights to being the "King of the World!"

Rules:

I. Players must remain behind the Bean Bag Marker when throwing with both the Approach Foot and the Shooting Foot for each shot. No progression to the next marker or a win is awarded if the player crosses the line.

EXAMPLE 6

BOOT-(1-4 People)(Singles or Teams)

Description—set a goal on a flat playing surface with at feast 30' in all directions around the goal. BOOT is played with the same structure whether "HORSE or PIG" in Basketball. PIG is the shorter version since you only have three letters as opposed to four or five. The game should be played using one Boot at a time. Therefore the flow of the game may be improved if the players alternate re-bounding the Boot in a safe place near the goal. The players take turns trying to make shots from a distance or location of their choice. If the player makes a basket the other players must also make a basket at that exact location or they will earn a letter. A player is eliminated from the game when they earn all four letters in the word "BOOT". In other words, they get the BOOT! Be sure that players continue to rotate between shots. Deciding who gets to make the first shot is up to you. Rock, Scissors, Paper maybe?

Freestyle Options

Playing freestyle is just like playing mini-golf. The only difference is that players pick natural or man-made features to serve as a goal or hole. For example, instead of the targets described herein (e.g., framed net and/or scoring tarp), a player may use a tree, gym set, telephone pole, sign, or mailbox. Just be sure the player picks a safe one. The freestyle option is similar to how traditional "shoe golf" is played. Freestyle is always a great option for keeping it simple and having fun.

UTILITY OF THE INVENTION

The following are the major features that we inventors considered when designing the game pieces of the embodiments of the instant invention:

1. Designed so players could keep their real shoes on and not ruin them by throwing them on dirt and asphalt. This required a toe box design that could accommodate different foot sizes, different ages and types of footwear.
2. Engineer the toe box that would enable a player to throw with more consistent and accurate control than a regular old shoe. This involved adding some aerodynamics, weight placement in the front of the toe box and special cut considerations to accommodate the release.
3. Create a cost effective and durable toe box so that the players could purchase multiple ones and they would last over time
4. Develop a scoring mechanism that made the game challenging yet gratifying for experienced players and beginners. This involved creating games that are played with an upright, netted goal and scoring tarp.

The Benefits

Shoot The Boots™ kick toss game is a family or friend game recommended for ages 8 and up. However, we the inventors have found that kick tossing the Boot accurately and consistently is an acquired skill that must be practiced. Shoot The Boots™ backyard and tailgating game test the players kick toss agility in order to score points. The game requires controlling the following major variables for a predicted kick toss and successfully hitting targets at various distances:

1. Pull back motion and distance
2. Pull through force
3. Pull through leg direction
4. Foot release position and motion
5. Whether the knee is bent or kept straight
6. Overall body coordination using arms and balance The above are some factors or variables that a player may wish to keep in mind to make a good shot. Nevertheless, each player will need to determine his preferred technique that will give him the winning edge. The benefit to playing Shoot The Boots™ kick toss game is that it can be challenging due to all the major variables involved with kick tossing a weighted toe box, which also creates opportunities to be the best.

Another benefit to Shoot The Boots™ kick toss game is that it makes a great social game when visiting people since it is hands-free, can be played in a calm manner and does not require much physical motion for most recommended game versions. The game even allows players to avoid bending over to pick up the boots when getting ready to shoot. That is what makes the game so ideal for backyard or tailgating fun.

Summary of Benefits

All ages 8 and up
Hands-Free (Big Plus)
Variety of Recommended Games
Single or Group Participation
Easy to Set-Up and Tear Down
Easy to Transport and Store
Moderately Safe if Played Correctly
Challenge and Opportunity to be the Best at a New Game
Sport your favorite team's colors
Durable Boot and Goal Design
Different from any other game!!!!

An artisan of ordinary skill will appreciate that various modifications may be made to the invention herein described without departing from the scope or spirit of the invention as defined in the appended claims.

What is claimed is:

1. A toe box article for a kick tossing game or activity, comprising:

(a) an upper, a sole, and two sidewalls that collectively adjoin to create a toe box cavity having an open proximal end and a closed distal end, said upper having a length, a width, and a proximal edge, said sole having a length, a width, and a proximal edge;

(b) a weighted nose within said closed distal end of said toe box cavity, said weighted nose having a proximal surface and a distal surface, said proximal surface having a weight retaining cavity at a central position within said proximal surface, and said distal surface comprising material padding; and (c) at least one weight held at a position within said weight retaining cavity;

(d) wherein said weight retaining cavity, said weight, and said material padding do not distribute into the-upper, sole, and two sidewalls of said toe box article;

(e) wherein said length of said sole is greater than said length of said upper such that said proximal edge of said sole extends beyond said proximal edge of said upper;

(f) wherein said toe box article is configured for unattached, slidable positioning externally over at least the front or toe portion of left or right footwear, without the use of hands or non-bodily apparatus, and when so fully positioned; said sole does not contact a heel portion of the footwear; and (g) said toe box article having mirror symmetry across a vertical plane extending through a central longitudinal axis of said toe box article.

2. The article of claim 1, wherein the toe box article is formed of at least one material selected from the group consisting of: polyvinylchloride, polyethylene, low density polyethylene (LDPE), high density polyethylene (HDPE), thermoplastic elastomer (TPE), polypropylene, ethylene vinyl acetate, acetate, butyrate, propionate, silicone, latex, and copolymers thereof.

3. The article of claim 1, wherein said position of said weight is configured such that said toe box article follows an accuracy maximizing trajectory to hit a target of said kick tossing game or activity.

4. The article of claim 1, further comprising a taper from said open proximal end to said closed distal end.

5. The article of claim 1, further comprising at least one wing or fin positioned on one or both lateral sides of said toe box as to make a flight of said toe box more streamlined.

6. The article of claim 3, wherein said target has a trajectory point of impact at least about 15 to 40 inches from ground level.

7. The article of claim 1, wherein said at least one weight comprises weight from about 3 to 25 ounces.

8. A method of performing a kick tossing game or activity, comprising:

(a) providing an article and a target for said kick tossing game or activity, said article comprising a toe box comprising:

(i) an upper, a sole, and two sidewalls that collectively adjoin to create a toe box cavity having an open proximal end and a closed distal end, said upper having a length, a width, and a proximal edge, said sole having a length, a width, and a proximal edge;

(ii) a weighted nose within said closed distal end of said toe box cavity, said weighted nose having a proximal surface and a distal surface, said proximal surface having a weight retaining cavity at a central position within said proximal surface, and said distal surface comprising material padding; and (iii) at least one weight held at a position within said weight retaining cavity;

(iv) wherein said weight retaining cavity, said weight, and said material padding do not distribute into the upper, sole, and two sidewasls of said toe box article;

(v) wherein said length of said sole is greater than said length of said upper such that said proximal edge of said sole extends beyond said proximal edge of said upper;

(vi) wherein said toe box article is configured for unattached, slidable positioning externally over at least a front or toe portion of left or right footwear, without the use of hands or non-bodily apparatus, and when so fully positioned, said sole does not contact a heel portion of the footwear; and (vii) said toe box article having mirror symmetry across a vertical plane extending through a central longitudinal axis of said toe box article;

(b) positioning said article on a ground surface such that said closed distal end of said toe box cavity faces said target;

(c) inserting a foot into said open proximal end of toe box cavity of said article on said ground surface;

(d) releasing said article from said foot using a foot pivoting, swinging leg motion, wherein said releasing directs said article toward said target.

9. The method of claim 8, wherein said releasing of said article follows a trajectory having a point of impact at or near said target.

10. The method of claim 9, wherein said target is selected from the group consisting of a tarp and a framed net suspended about 15 to 40 inches above the ground surface.

11. The method of claim 8, wherein inserting the toe box article is accomplished in a hands-free-manner.

12. The method of claim 8, wherein pivoting the foot to kick toss or flip the toe box article off of the footwear is accornplished in a hands-free manner.

13. The method of claim 9, wherein said position of said weight is configured to maximize accuracy of said trajectory to hit said target.

14. The method of claim 10, wherein said framed net comprises:

a frame having one or more vertical supports to support a rim at an elevation of about 15 inches to about 40 inches above a ground surface; and a netting forming a goal basket suspended from the rim.

15. The method of claim 14, wherein the rim is a ring and the vertical supports are rotatably connected to said ring.

16. The method of claim 14, wherein said rim comprises a ring measuring about 10 to 40 inches in diameter.

17. The method claim 15, further comprising a second ring forming a support footing for the tossing game goal, to which the vertical supports are rotatably connected.

18. The method of claim 17, further comprising at least one rubberized goal foot attached to said support footing to provide a high friction interface with the ground surface.

19. The method of claim 15, wherein at least one of the vertical supports a different length than other vertical supports so as to support the rim in a tilted orientation.

20. The article of claim 1, wherein said mirror symmetry provides structural balance of said toe box article, said structural balance is configured such that said toe box article produces minimal air resistance while following an accuracy maximizing trajectory to hit a target of said kick tossing game or activity.

21. The article of claim 1, wherein said weight within said weighted nose is sufficiently weighted and positioned to engage said toe box article over footwear at a projection angle for following an accuracy maximizing trajectory to hit a target of said kick tossing game or activity.

22. The article of claim 1, wherein said toe box article having a length as measured from a rear edge of said sole to said open proximal end of said toe box cavity, and a width measured a distance across the sole between said two sidewalls, wherein a ratio of said length to said width is approximately 75 percent.

* * * * *